US007887389B1

(12) United States Patent
Lacambra

(10) Patent No.: US 7,887,389 B1
(45) Date of Patent: Feb. 15, 2011

(54) SUPPORT PAD FOR AN UNDERGARMENT

(75) Inventor: Vince Lacambra, Galena, OH (US)

(73) Assignee: A & F Trademark, Inc., New Abany, OH (US)

( * ) Notice: Subject to any disclaimer, the term of this patent is extended or adjusted under 35 U.S.C. 154(b) by 586 days.

(21) Appl. No.: 12/000,665

(22) Filed: Dec. 14, 2007

Related U.S. Application Data

(60) Provisional application No. 60/874,947, filed on Dec. 15, 2006.

(51) Int. Cl.
*A41C 3/00* (2006.01)

(52) U.S. Cl. ..... 450/39; 450/57

(58) Field of Classification Search ..... 450/36–39, 450/41, 43, 44, 54–57; 2/267, 268
See application file for complete search history.

(56) References Cited

U.S. PATENT DOCUMENTS

| | | | |
|---|---|---|---|
| 1,750,084 | A | 3/1930 | Abrahamson |
| 1,844,888 | A | 2/1932 | Lorenz |
| 1,989,303 | A | 1/1935 | Alberts |
| 2,782,417 | A | 2/1957 | Magidson |
| 2,787,790 | A | 4/1957 | Kahn |
| 2,844,151 | A | 7/1958 | Lemons |
| 2,864,373 | A | 12/1958 | Buckley |
| 2,973,763 | A | 3/1961 | Rowell |
| 3,067,750 | A | 12/1962 | Schwartz |
| 3,297,035 | A | 1/1967 | Wright |
| 3,747,606 | A | 7/1973 | Tareau |
| 3,777,763 | A | 12/1973 | Schwartz |
| 3,998,231 | A | 12/1976 | Delet |
| 4,235,240 | A | 11/1980 | Cousins |
| 4,372,320 | A | 2/1983 | Silber |
| 4,398,538 | A | 8/1983 | Johnson |
| 4,646,746 | A | 3/1987 | O'Boyle |
| 4,770,650 | A | 9/1988 | Rowell |
| 4,781,650 | A | 11/1988 | Budd |
| 4,956,878 | A | 9/1990 | Boynton |
| 5,033,986 | A | 7/1991 | Feigenbaum |
| 5,141,470 | A | 8/1992 | Morgan |
| 5,219,311 | A | 6/1993 | Fildan |
| 5,527,202 | A | 6/1996 | Morgan |

(Continued)

FOREIGN PATENT DOCUMENTS

| | | |
|---|---|---|
| CN | 1554297 | 7/2005 |

(Continued)

*Primary Examiner*—Gloria Hale
(74) *Attorney, Agent, or Firm*—Howrey LLP

(57) ABSTRACT

The present invention is directed to a support pad for an undergarment. The support pad may be formed by placing a layer of support material between an outer layer and an inner layer. Both the outer layer and the inner layer may include a foam portion and a cover lining portion. In one embodiment, an area of the foam in either the outer layer or the inner layer, or both, may have a reduced thickness formed by shaving or compressing. The support pad according to the present invention incorporates support material into the support pad so there is no need for the attachment of elastic to the outside of the pad. As such, the support pad is sleeker and lighter than previous support pads, and does not result in unsightly seams which may be visible through clothing worn over a garment having the pad.

23 Claims, 6 Drawing Sheets

U.S. PATENT DOCUMENTS

| | | | |
|---|---|---|---|
| 5,678,246 | A | 10/1997 | Cooley |
| 5,730,640 | A | 3/1998 | Acx |
| 5,951,365 | A | 9/1999 | Fildan |
| 6,053,800 | A | 4/2000 | Lattanzi |
| 6,190,232 | B1 | 2/2001 | Boser |
| 6,241,576 | B1 | 6/2001 | Hofer |
| 6,299,504 | B1 | 10/2001 | Gluckin |
| 6,346,028 | B1 | 2/2002 | Fildan |
| 6,431,946 | B1 | 8/2002 | Fildan |
| 6,435,939 | B1 | 8/2002 | Lin |
| 6,443,805 | B1 | 9/2002 | Kirkwood |
| 6,447,365 | B1 | 9/2002 | Powell |
| 6,796,876 | B2 | 9/2004 | Luk |
| 6,805,610 | B2 | 10/2004 | Luk |
| 6,805,611 | B2 | 10/2004 | Luk |
| 6,805,612 | B1 | 10/2004 | Luk |
| 6,811,464 | B2 | 11/2004 | Li |
| 6,824,444 | B2 | 11/2004 | Huang |
| 6,837,772 | B1 | 1/2005 | Luk |
| 6,857,933 | B2 | 2/2005 | Horta |
| 6,857,934 | B2 | 2/2005 | Chan |
| 6,878,033 | B2 | 4/2005 | Luk |
| 6,899,590 | B2 | 5/2005 | Luk |
| 6,966,815 | B2 | 11/2005 | Weinerth |
| 6,986,696 | B1 | 1/2006 | Jagaric |
| 6,986,697 | B2 | 1/2006 | Luk |
| 6,988,931 | B1 | 1/2006 | Martinet |
| 6,997,775 | B2 | 2/2006 | Jagaric |
| 7,032,626 | B2 | 4/2006 | Glenn |
| 7,044,829 | B1 | 5/2006 | Jagaric |
| 7,048,606 | B1 | 5/2006 | Martinet |
| 7,052,360 | B2 | 5/2006 | Lau |
| 7,166,012 | B2 | 1/2007 | Lau |
| 7,311,583 | B2 | 12/2007 | Jagaric |
| 7,341,500 | B2 | 3/2008 | Horn |
| 2003/0134568 | A1 | 7/2003 | Bark |
| 2004/0224604 | A1 | 11/2004 | Luk |
| 2005/0014450 | A1 | 1/2005 | Luk |
| 2005/0197043 | A1 | 9/2005 | Horta |
| 2005/0272345 | A1 | 12/2005 | Lau |
| 2006/0030238 | A1 | 2/2006 | Jagaric |
| 2006/0105673 | A1 | 5/2006 | Lau |
| 2006/0105674 | A1 | 5/2006 | Lau |
| 2006/0141905 | A1 | 6/2006 | Lau |
| 2006/0253960 | A1 | 11/2006 | Horn |
| 2007/0066181 | A1 | 3/2007 | Lau |
| 2007/0251636 | A1 | 11/2007 | Herbert |
| 2007/0298680 | A1 | 12/2007 | Martinet |

FOREIGN PATENT DOCUMENTS

| | | |
|---|---|---|
| FR | 2730608 | 8/1996 |
| JP | 02091202 | 3/1990 |
| JP | 8144150 | 6/1996 |
| JP | 09031795 | 2/1997 |
| JP | 2000054204 | 2/2000 |
| JP | 2001288604 | 10/2001 |
| JP | 2001295108 | 10/2001 |
| JP | 2002235210 | 8/2002 |
| JP | 2003301355 | 10/2003 |
| JP | 2004316042 | 11/2004 |
| JP | 2005076138 | 3/2005 |

SUPPORT PAD FOR AN UNDERGARMENT

RELATED U.S. APPLICATIONS

This application claims the benefit of U.S. provisional application Ser. No. 60/874,947 filed Dec. 15, 2006 and entitled "Support Pad for Undergarments." The foregoing application is hereby incorporated herein by reference.

FIELD OF THE INVENTION

The present invention relates to a support pad for an undergarment that provides breast support. More specifically, the present invention relates to a support pad having support material positioned within the foam of the pad.

BACKGROUND OF THE INVENTION

Support pads for undergarments are often cut and molded out of foam material. To increase the comfort of the wearer of an undergarment having a support pad and conform better to the wearer's natural body shape, the foam material is often "shaved" around the edges to reduce its thickness. However, the reduced thickness of the foam material causes the edges of the foam material to become unstable once the foam is molded and cut into a support pad. For example, the edges of the pad may be prone to stretching or fraying as a result of the reduced thickness and shaving.

To counter the effects of shaving the foam material, manufacturers will typically sew or attach elastic or other material along the edge of a shaved foam support pad after it has been molded and cut. However, this often results in a wide, bulky seam at the locations where the elastic or other material is attached to the pad. This seam may cause discomfort to the wearer of an undergarment having the support pad, or the seam may be visible when an undergarment having the support pad is worn beneath other clothing. Moreover, the additional step of adding the seam can add to the overall cost of manufacturing the pad.

As such, what is needed is a sleeker looking and lighter support pad for an undergarment which does not jeopardize fit and functionality.

SUMMARY OF THE INVENTION

The present invention relates to a support pad for an undergarment that provides breast support. More specifically, the present invention relates to a support pad having support material positioned within the foam of the pad.

One embodiment of the present invention includes a support pad for an undergarment having a substantially arcuate shape with an inner surface and an outer surface. The support pad according to this embodiment may comprise an outer layer comprised of a first layer of lining fabric attached to a first layer of foam, the first layer of lining fabric and the first layer of foam being substantially coextensive, and an inner layer comprised of a second layer of lining fabric attached to a second layer of foam, the second layer of lining fabric and the second layer of foam being substantially coextensive. The support pad may also include a layer of support material positioned between at least a portion of said outer layer and at least a portion of said inner layer, wherein the first layer of lining fabric forms the outer surface of the support pad and the second layer of lining fabric forms the inner surface of the support pad.

In another embodiment of the present invention, a method of manufacturing is contemplated. The method according to this embodiment may comprise the steps of positioning a layer of support material between at least a portion of a first layer of foam and at least a portion of a second layer of foam to form a pre-cut block, molding the pre-cut block to create a molded portion in the pre-cut block, the molded portion including a portion of the first layer of foam, a portion of the second layer of foam and a portion of the layer of support material, and cutting the molded portion from the pre-cut block to create a support pad for an undergarment, the support pad being formed by the portion of the first layer of foam, the portion of the second layer of foam and the portion of the layer of support material included in the molded portion.

Another embodiment of the present invention also includes a method of manufacturing. The method according to this embodiment may comprise the steps of molding a first layer of foam to create an arcuate shape in at least a portion of the first layer of foam, attaching a layer of support material to at least a portion of the first layer of foam, attaching a second layer of foam to both the first layer of foam and the layer of support material to create a pre-cut block, and molding the pre-cut block to create a molded portion in the pre-cut block, the molded portion including a portion of the first layer of foam, a portion of the second layer of foam and at least a portion of the layer of support material. The method may also comprise the step of cutting the molded portion from the pre-cut block to create a support pad for an undergarment, the support pad being formed by the portion of the first layer of foam, the portion of the second layer of foam and the at least a portion of the layer of support material included in the molded portion.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference to the Figures in which various embodiments of the present invention are shown. The subject matter of this disclosure may, however, be embodied in many different forms and should not be construed as being limited to the embodiments set forth herein.

The present invention relates to a support pad for an undergarment that provides breast support. More specifically, the present invention relates to a support pad having support material positioned within the foam of the pad, resulting in a sleeker and lighter support pad than previous support pads without jeopardizing fit and functionality. In one embodiment, the support pad according to the present invention may be incorporated into an undergarment. In alternative embodiments, the support pad according to the present invention may be manufactured separately as an "insert" for garments having "built in" or integrated breast support functionality.

As discussed below, the support pad according to the present invention eliminates the need to attach elastic or other support material to the edges of foam after the foam has been cut or shaved. This is accomplished by incorporating the step of providing support for the foam material into the molding and cutting process, as discussed below. As a result, the support pad of the present invention may eliminate the uncomfortable and unsightly seams of previous support pads while maintaining the integrity of the pad.

Figure 1A:
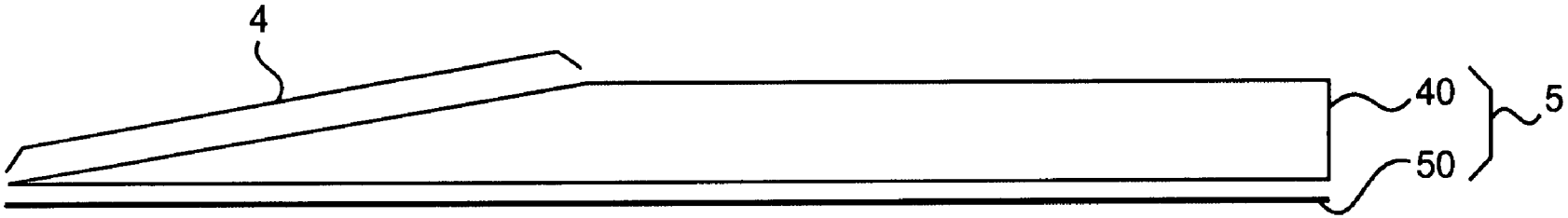
FIGS. 1A and 1B illustrate a laminated, shaved foam layer for use in the formation of a support pad according to one embodiment of the present invention.
Figure 1B:
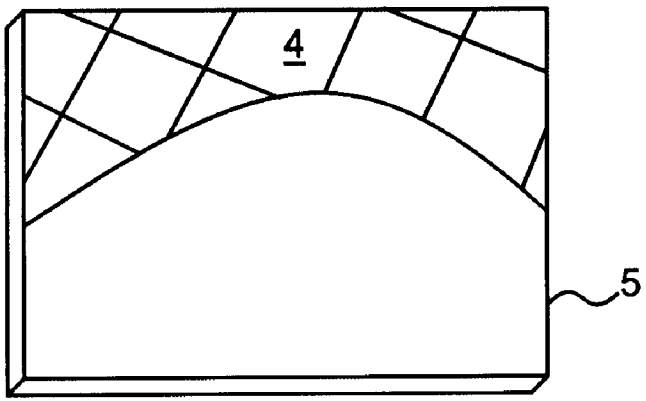

The support pad according to the present invention may be manufactured by first attaching a lining fabric 50 to foam 40, as illustrated in FIGS. 1A and 1B. This attachment may be accomplished by any attachment means known in the art including, but not limited to, laminating, stitching, bonding, gluing, heating, spray gluing, compressing and ultrasonic bonding. The foam 40 may be any conventional, commercially available foam material known to one of ordinary skill in the art including, but not limited to, stay-white foam, semi-stay white foam, stretch foam and rigid foam. Likewise, the lining fabric 50 may be any conventional, commercially available lining material known to one of ordinary skill in the art including, but not limited to, polyester, cotton, nylon, latex, lace, spandex/elastane or any suitable combination of materials.

As shown in FIGS. 1A and 1B, after the foam 40 and lining fabric 50 have been attached, they may form a layer 5 from which an outer pad portion may be formed, as discussed with respect to FIG. 2 below. In one embodiment, and as illustrated in FIGS. 1A and 1B, a portion of the foam 40 in layer 5 may be shaved using any commercially available shaving machine known in the art in a desired area 4 to reduce the thickness or weight of at least a portion of the foam 40, or to obtain a smoother edge of the final product. While the figures illustrate shaved area 4 as having a tapered thickness, it is contemplated that the shaving may be accomplished such that the shaved area 4 has any side profile, including a single thickness or "stepped" thicknesses, as will be recognized by one of skill in the art. One of skill in the art will recognize that, by shaving at least a portion of the foam, the overall weight of the support pad may be reduced. Alternatively, compression techniques known to those of skill in the art may also be used to reduce the thickness of all or a portion of the foam. Further, a combination of both shaving and compression to reduce the thickness is also contemplated in the present invention.

It is contemplated that the shape and dimensions of the materials utilized in the present invention may vary based on the desired fit and functionality of a garment utilizing the support pad of the present invention. For example, in one embodiment of the present invention, a block of foam 6 mm thick in the unshaved areas and a sheet of lining fabric approximately 1 mm thick (thereby giving layer 5 a thickness of approximately 7 mm thick in the unshaved areas) may be used. As illustrated in the figures, in one embodiment, the shaved area 4 may be tapered from 6 mm thick to a minimum thickness at the edges (which may be any desired thickness). It should be recognized that varied thicknesses may alter the functionality of the support pad because, as one of ordinary skill in the art will recognize, while thicker pads may provide greater support to the breasts of a wearer, they may also increase the overall weight of the garment.

Figure 2:
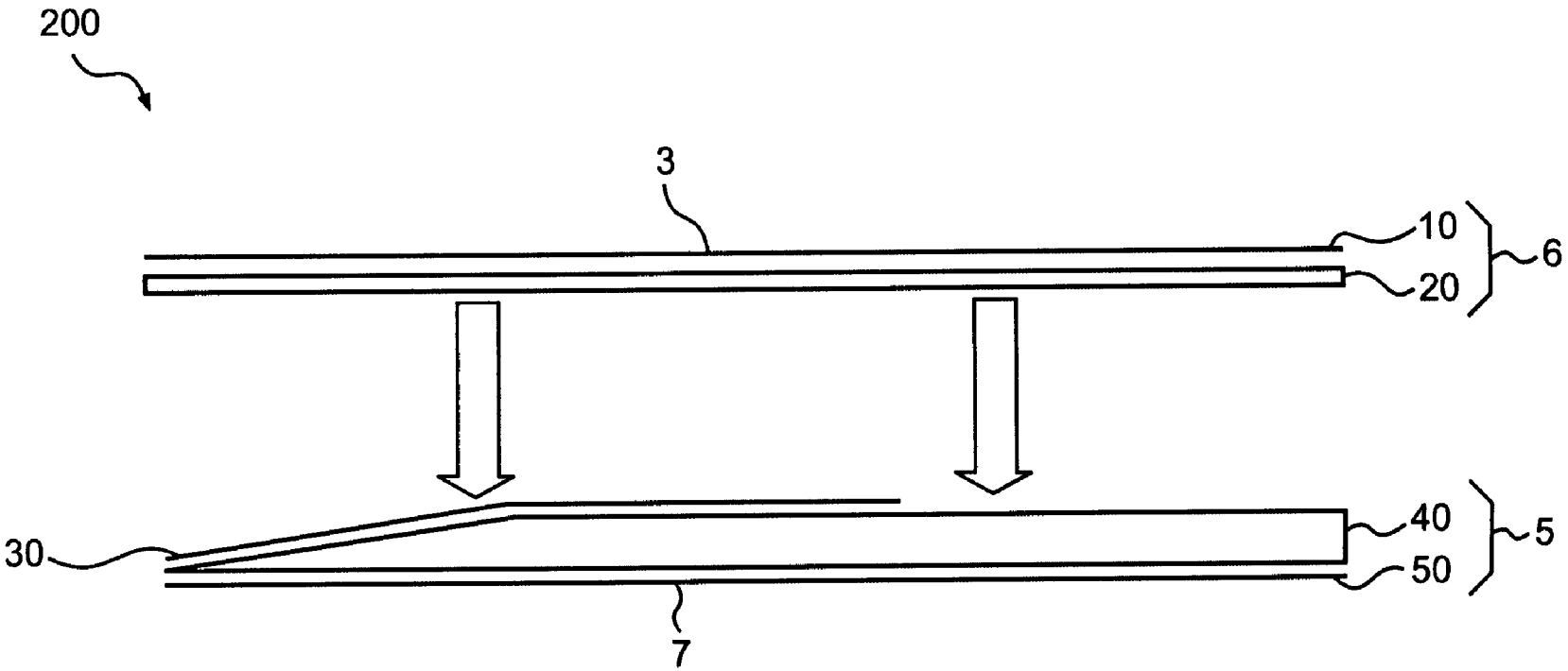
FIG. 2 illustrates an exploded side view of the formation of a pre-cut block used to form a support pad according to one embodiment of the present invention.

FIG. 2 illustrates an exploded side view of the formation of a pre-cut block 200 used to form a support pad according to one embodiment of the present invention. As shown in FIG. 2, layer 5 may be used to form an outer pad portion. Additionally, a second layer 6, having foam 20 laminated with lining fabric 10, may be formed in a manner similar to that used to form layer 5. As illustrated, layer 6 may be used to form an inner pad portion. While FIG. 2 illustrates layer 6 as utilizing foam 20 of less thickness than foam 40 used in layer 5, it is contemplated that the foam utilized in layer 6 may have any dimensions desirable to one of skill in the art, as discussed above with respect to foam 40. Furthermore, while foam 20 is illustrated as being unshaved, it is contemplated that foam 20 may also be shaved in any desirable area in the same manner discussed above in order to decrease the thickness and overall weight of the support pad.

As shown in FIG. 2, a layer of support material 30 may be positioned between all or a portion of the outer layer 5 and all or a portion of the inner layer 6. In one embodiment, the support material 30 may be formed of lightweight mesh such as the mesh commercially manufactured by Pacific Textiles. In one embodiment, the mesh may be formed from a spandex/nylon blend. However, one of skill in the art will recognize that any type of conventional, commercially available material may be used for the support material 30 provided the overall design and usefulness of the present invention is retained. This may include, but is not limited to, materials such as polyester, cotton, latex, lace, spandex/elastane, rubber, plastic, metal or any suitable combination of materials. Additionally, the support material 30 may have any thickness, material properties (such as flexibility/rigidity or stretchability) or geometric properties (including, but not limited to, perforations having different sizes or dimensions) depending on the type of support desired for the support pad. Further, it is contemplated that one support pad could include various types of support material 30 having varying thicknesses, material properties or geometric construction to provide different amounts of support at different locations within the support pad.

Figure 3:
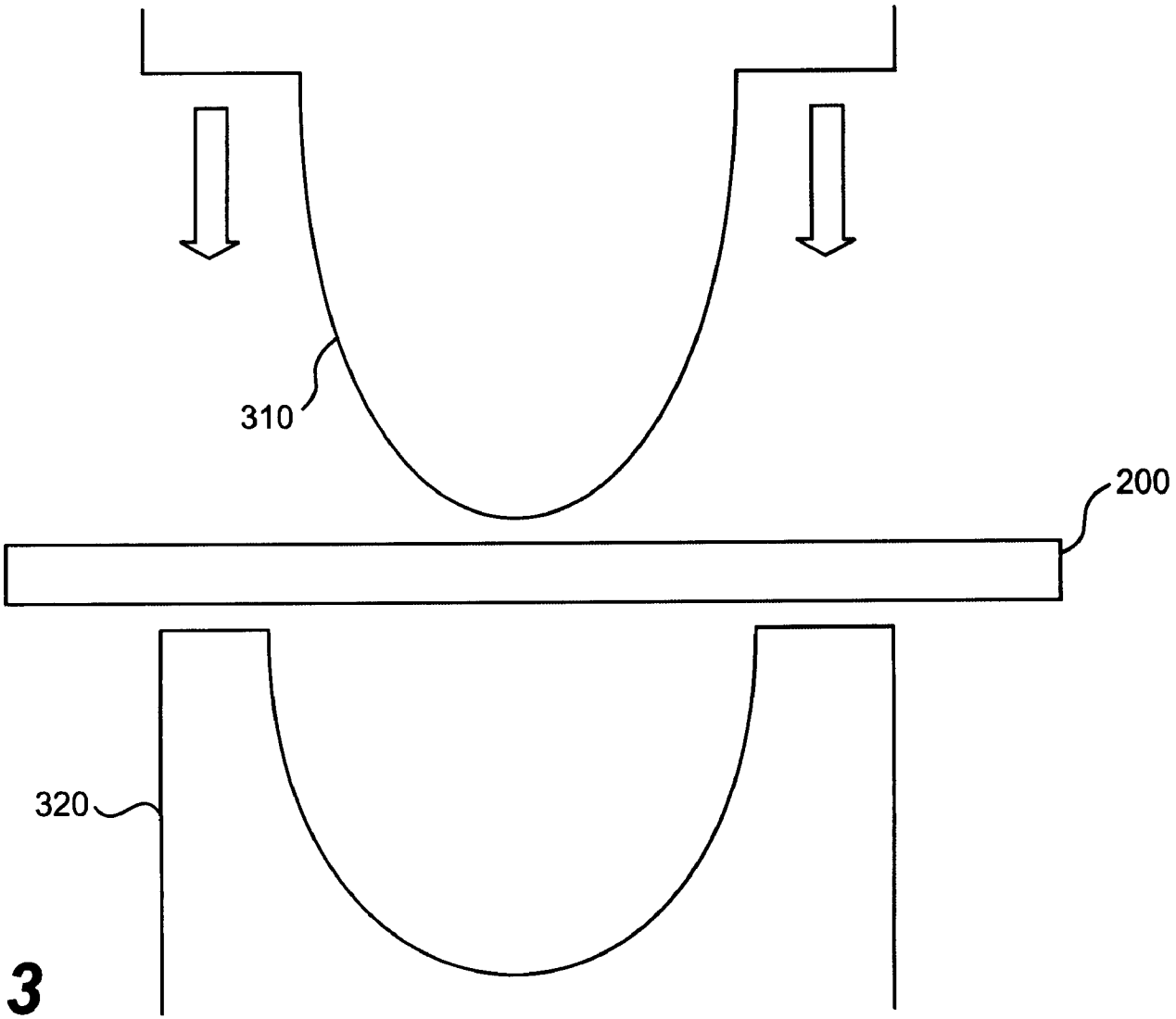
FIG. 3 illustrates a side view of the molding of a pre-cut block according to one embodiment of the present invention.

Once the outer layer 5, the support material 30 and the inner layer 6 are substantially aligned, the layers may be attached to one another using any conventional attachment methods known to one of skill in the art including, but not limited to, laminating, stitching, bonding, gluing, heating, spray gluing, compressing and ultrasonic bonding. This may form a pre-cut block 200 having an inner surface 3 and an outer surface 7 from which a support pad according to the present invention may be molded and cut. FIG. 3 illustrates a side view of the molding of a pre-cut block 200 according to one embodiment of the present invention (where the individual layers of the pre-cut block 200 are not illustrated).

As shown in FIG. 3, the pre-cut block 200 may be placed in a molding machine having a male mold 310 and a female mold 320. The molding machine (not shown) and molds 310 and 320 may be any conventional machine and molds known to those of skill in the art. Furthermore, the size, depth, curvature and other characteristics of the molds may vary depending on the desired shape and usage of the final support pad, as will be recognized by one of ordinary skill in the art.

Figure 4:
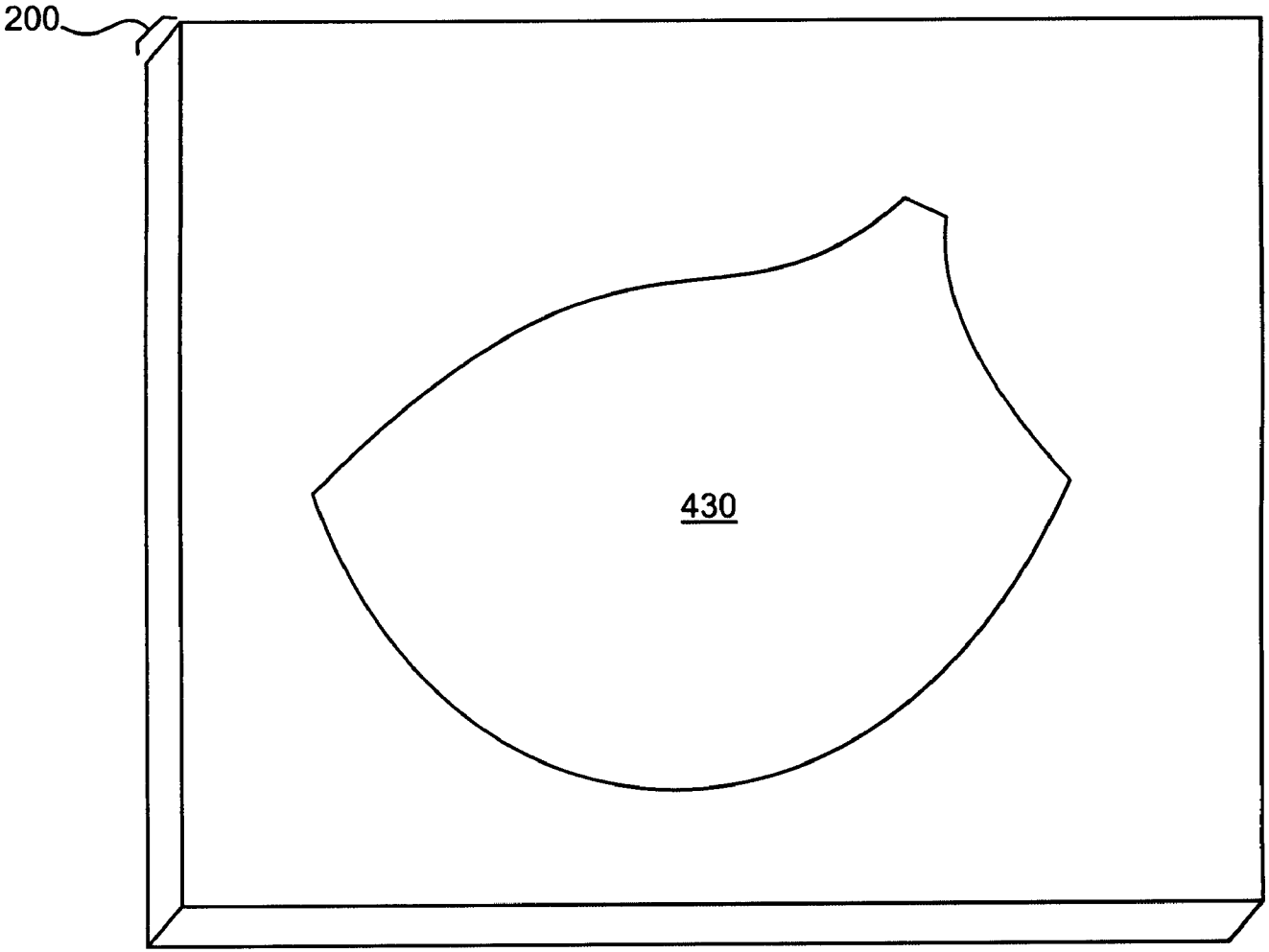
FIG. 4 illustrates a pre-cut block having a molded support pad according to one embodiment of the present invention.

As illustrated in FIG. 4, the molding machine and molds 310 and 320 may be used to shape a portion of the pre-cut block 200 into a substantially arcuate shaped support pad according to the present invention. FIG. 4 illustrates a pre-cut block 200 having a molded portion 430 according to one embodiment of the present invention.

After the molding is complete, the molded portion 430 of the pre-cut block 200 may then be cut out of the pre-cut block 200 to create a support pad according to the present invention. The step of cutting a molded portion out of a pad is known to one of skill in the art. It is contemplated that any type of conventional cutting known to one of skill in the art may be used including, but not limited to, hand cutting or die cutting. Once the cutting step is complete, a support pad 500 according to the present invention may be formed. As mentioned above, the support pad 500 may have an arcuate shape configured to provide support to a wearer's breast. Furthermore, the support pad 500 may have inner and outer surfaces, with the inner surface intended to be worn closer to the skin of the wearer.

Figure 5:
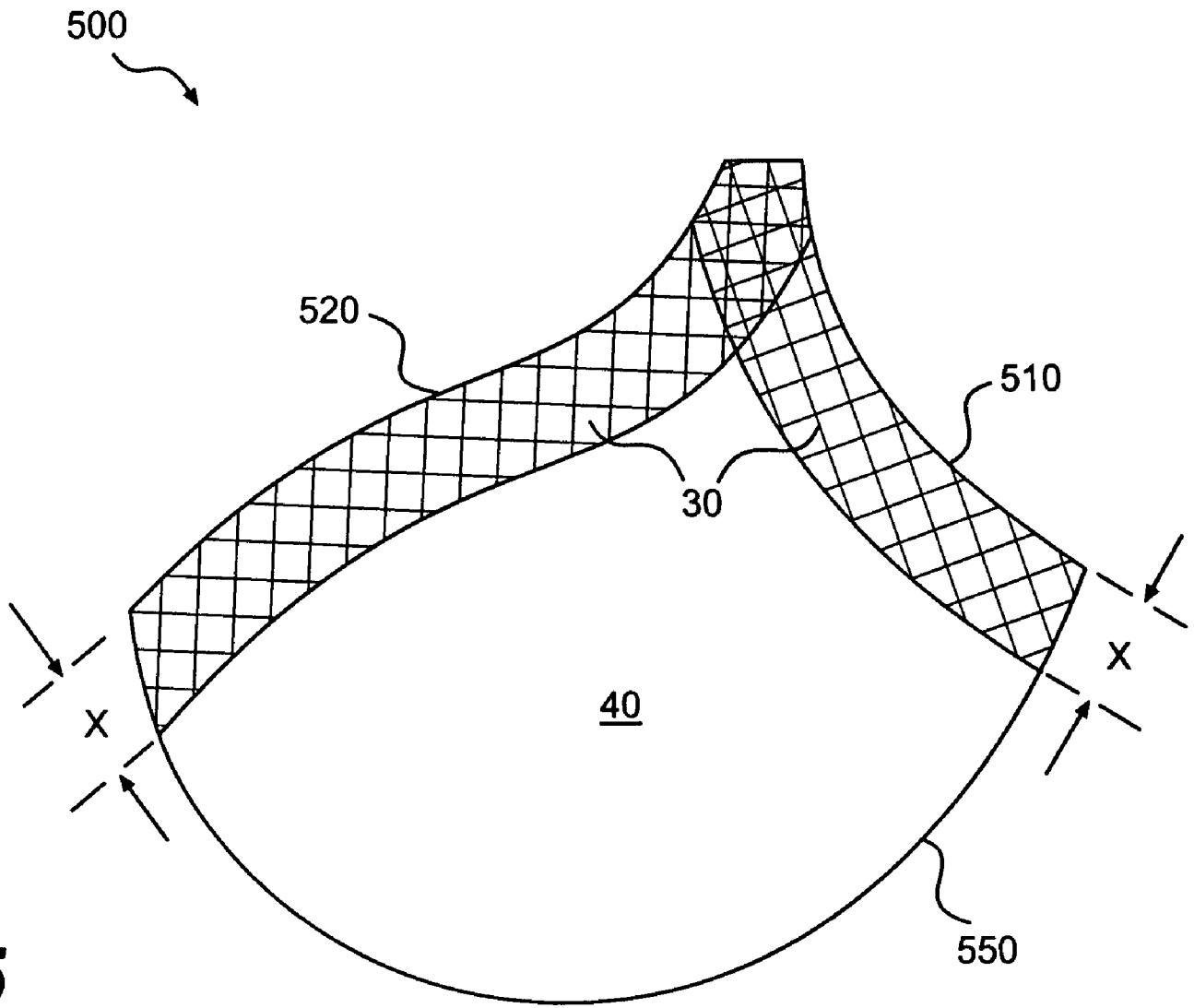
FIG. 5 illustrates a cut-away top view of a single support pad according to one embodiment of the present invention.

FIG. 5 illustrates a cut-away top view of a single support pad 500 according to one embodiment of the present invention. As discussed above, the support material 30 may be positioned at strategic locations within layers 5 and 6 of the support pad. In the exemplary embodiment illustrated in FIG. 5, the support material 30 may be positioned adjacent one or more of the edges forming the perimeter of the support pad 500 after cutting. As illustrated in FIG. 5, the support material may be placed such that it has a width X. In one embodiment, width X may be 0.75 inches. However, it is also contemplated that the width X may be any distance, depending on the type of support desired for the final support pad. Furthermore, it is also contemplated that the support material 30 may be placed between foam layers 20 and 40 at other strategic locations, or along multiple edges of the support pad, as illustrated in FIG. 5.

As illustrated in FIG. 5, the perimeter of the single support pad 500 may be formed by a neckline edge 520, an underarm edge 510 and a bottom edge 550. The single support pad 500 may be incorporated into an undergarment or other types of garments such that the pad 500 covers a wearer's breast and the neckline edge 520 is positioned to face the wearer's neck, the underarm edge 510 is positioned to face the wearer's underarm and the bottom edge 550 is positioned to face the wearer's midsection. In an alternative embodiment, a support pad may be formed to be used with a "strapless" bra, as commonly known to those of skill in the art. In this embodiment, one of ordinary skill in the art will realize that the support pad may be formed in the same manner discussed above but that it may not include an underarm edge.

As discussed above, the support pad 500 according to the present invention may be incorporated into an undergarment. For example, the support pad 500 may be sewn into, or attached to, a garment such that the garment includes the support pad for breast support. In one alternative embodiment, the support pad according to the present invention may be manufactured separately as an "insert" for garments having optional breast support functionality. In another alternative embodiment, the support pad 500 may be attached to other elements including, but not limited to, shoulder straps, back straps or another support pad to form an undergarment. Because of the presence of the support material within the support pad 500, a stronger attachment where other elements of various garments are attached to the area of the support pad having the support material will result.

While the above method for manufacturing a support pad 500 according to the present invention is discussed, it is contemplated that other methods of manufacturing a similar support pad 500 may be utilized. For example, in an alternative embodiment, a support pad 500 may also be manufactured by creating the outer layer 5 and the inner layer 6 as discussed above with respect to FIGS. 1A, 1B and 2 but without initially placing the support material 30 between the two layers. As discussed above, one or both of these layers 5 and 6 may then be shaved and/or compressed in strategic locations to reduce the thickness and weight of the layer. Next, one or both of the layers 5 and 6 may then be initially molded in a similar manner as discussed above with respect to FIG. 3 to create a layer having a molded portion similar to the molded portion shown and discussed above with respect to FIG. 4.

Once one or both of the layers 5 and 6 are molded to include a molded portion, support material 30 (as discussed above) may then be attached at strategic locations to the molded portion of a molded layer, in the same manner as discussed above with respect to FIG. 2. This attachment may be accomplished by any attachment means known in the art including, but not limited to, laminating, stitching, bonding, gluing, heating, spray gluing, compressing and ultrasonic bonding.

Once the support material 30 is attached to a molded layer 5 or 6, the other layer 5 or 6 (i.e., the layer to which the support material is not attached) may then be attached to the layer having the support material 30 attached to create a block having an inner layer 6, an outer layer 5 and a layer of support material 30 strategically placed therebetween. This attachment may be accomplished by any attachment means known in the art including, but not limited to, laminating, stitching, bonding, gluing, heating, spray gluing, compressing and ultrasonic bonding.

It should be noted that the block created according to this embodiment and the block 200 discussed above with respect to FIG. 2 differ because the block created according to this embodiment includes one or more layers which were molded prior to the creation of the block. Indeed, in one embodiment, the block may have one molded layer, one non-molded layer, and a layer of support material placed therebetween. In another embodiment, the block may have one molded layer, another molded layer and a layer of support material placed therebetween.

Once both layers and the support material are attached to form a block, the entire block may then be molded to mold and/or seal the layers together and to create a block having a molded portion as discussed above and illustrated in FIG. 4. The molded portion may then be cut, as discussed above, to create a support pad 500 according to the present invention.

Figure 6:
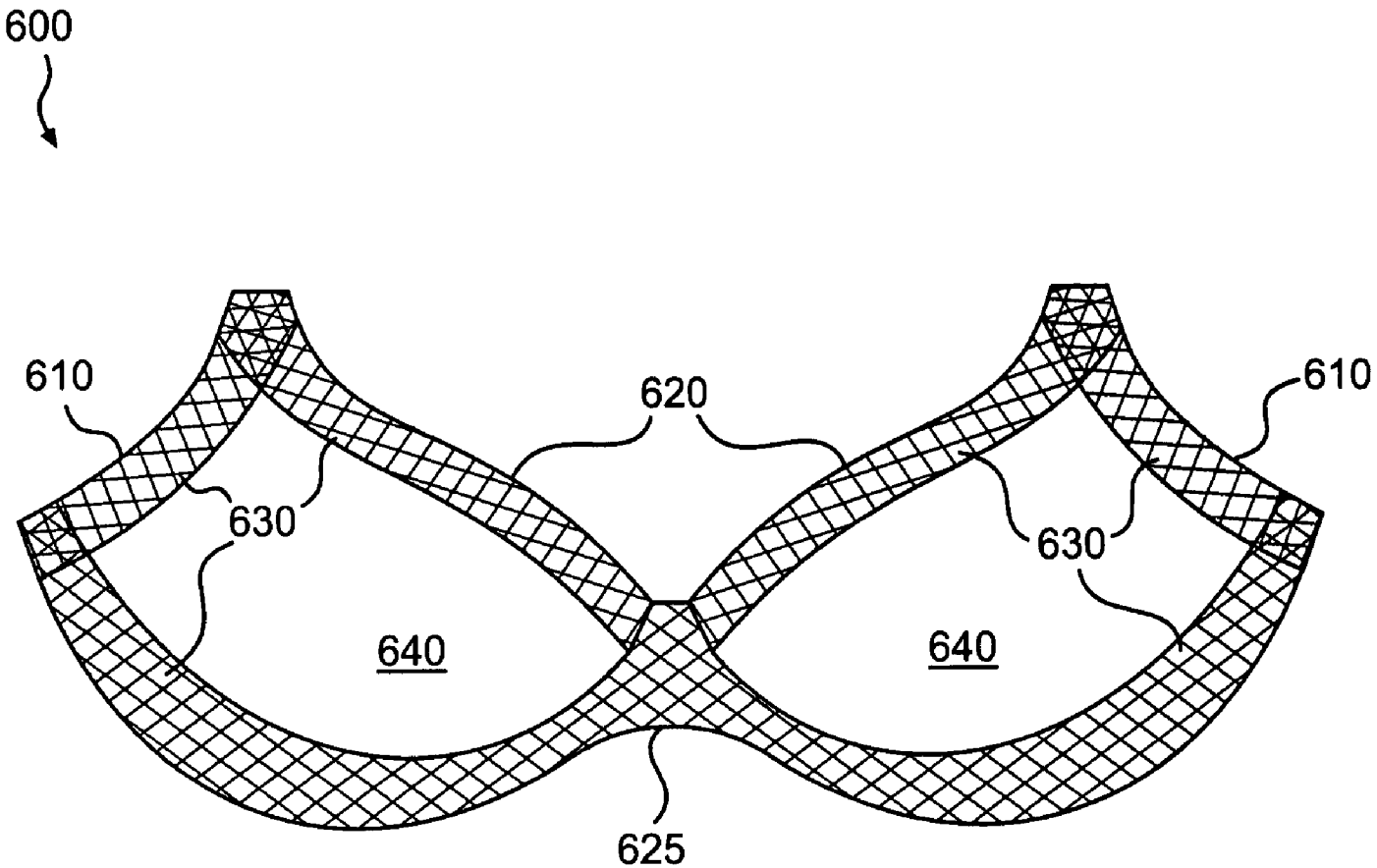
FIG. 6 illustrates a cut-away top view of a one piece combination support pad according to one embodiment of the present invention.

In yet another alternative embodiment, a one piece combination support pad for supporting both breasts of a woman wearing the garment is contemplated. As will be recognized by one of ordinary skill in the art, such a one piece combination support pad may be manufactured using the same method discussed above with respect to FIGS. 1-4 without deviating from the scope and spirit of the present invention. FIG. 6 illustrates a cut-away top view of a one piece combination support pad 600 according to one embodiment of the present invention.

As mentioned above, the one piece combination support pad 600 may be molded and cut using a similar process as the process discussed above with regard to the single support pad 500. As illustrated in FIG. 6, the one piece combination support pad 600 may include a neckline edge 620, two underarm edges 610 and a bottom edge 625. The pad 600 may be incorporated into an undergarment or other types of garments such that the pad 600 covers both of a wearer's breasts and the neckline edge 620 is positioned to face the wearer's neck, the underarm edges 610 are positioned to face the wearer's underarms and the bottom edge 625 is positioned to face the wearer's midsection.

As shown in FIG. 6, the support pad 600 may include an outer layer 640 and a layer of support material 630 laid over the outer layer 640, similar to the illustration in FIG. 5 for the single support pad 500. While the inner layer is not shown in FIG. 6 so that the placement of the support material 630 is visible, it should be recognized that the inner layer may be laid over the layer of support material 630 and the outer layer 640, as discussed above with respect to the single support pad 500.

One of ordinary skill in the art should recognize that the various embodiments discussed above are only intended to be exemplary. As such, it is contemplated that additional layers of foam and support material may be used in a support pad according to the present invention to provide additional thickness or support as desired. Furthermore, once the support pad is molded and cut, additional layers may be attached to one another using any conventional means for attaching known to those of skill in the art including, but not limited to, laminating, stitching, bonding, gluing, heating, spray gluing, compressing and ultrasonic bonding.

As will be recognized by one of ordinary skill in the art, the support pad according to the present invention results in a sleeker and lighter support pad than previous support pads without jeopardizing the fit and functionality of the pad. Because the support material may be placed inside of the layers prior to molding and cutting the support pad, there is no need for the additional step of attaching bulky support material to the pad after cutting, as required by prior art support pads. This results in greater efficiency during production and also results in a lighter support pad because there is no additional material needed to attach the support material to the foam material. Furthermore, there are no unsightly seams which may be visible through clothing worn over a garment having the support pad.

The foregoing descriptions of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. A support pad for an undergarment having a substantially convex shape with a first surface and a second surface, the support pad comprising:

a first layer comprised of a first layer of lining fabric attached to a first layer of foam, the first layer of lining fabric and the first layer of foam being substantially coextensive;

a second layer comprised of a second layer of lining fabric attached to a second layer of foam, the second layer of lining fabric and the second layer of foam being substantially coextensive; and a layer of support material positioned between at least a portion of said first layer and at least a portion of said second layer; wherein the support material is mesh;

wherein the first layer of lining fabric forms the second surface of the support pad and the second layer of lining fabric forms the first surface of the support pad.

2. The support pad according to claim 1, wherein:

the support pad has a perimeter which includes an upper edge being called a neckline edge and a peripheral edge being called an underarm edge; and said layer of support material is positioned adjacent to at least one of the neckline edge and the underarm edge.

3. The support pad according to claim 1, wherein the support pad has a perimeter which includes an upper edge being called a neckline edge; and said layer of support material is positioned adjacent to the neckline edge.

4. The support pad according to claim 1, wherein at least one of the first layer of foam and the second layer of foam includes an area of reduced thickness.

5. The support pad according to claim 4, wherein the area of reduced thickness is formed by shaving or compression.

6. A method of manufacturing a support pad for an undergarment comprising the steps of:

positioning a layer of support material between at least a portion of a first layer of foam and at least a portion of a second layer of foam to form a pre-cut block; wherein the support material is mesh;

molding the pre-cut block to create a three-dimensional molded portion in the pre-cut block, the molded portion including a portion of the first layer of foam, a portion of the second layer of foam and a portion of the layer of support material;

cutting the molded portion from the pre-cut block to create a support pad for an undergarment, the support pad being formed by the portion of the first layer of foam, the portion of the second layer of foam and the portion of the layer of support material included in the molded portion.

7. The method of claim 6, further comprising the steps of:

attaching a first layer of lining fabric to the first layer of foam; and attaching a second layer of lining fabric to the second layer of foam.

8. The method of claim 7, wherein:

the support pad has a substantially convex shape with a first surface and a second surface; and the first layer of lining fabric forms the second surface of the support pad and the second layer of lining fabric forms the first surface of the support pad.

9. The method of claim 6, wherein:

the support pad has a perimeter which includes an upper edge being called a neckline edge and a peripheral edge being called an underarm edge; and the support material is positioned adjacent to at least one of the neckline edge and the underarm edge after the step of cutting.

10. The method of claim 6, wherein:

the support pad has a perimeter which includes an upper edge being called a neckline edge; and the support material is positioned adjacent to the neckline edge after the step of cutting.

11. The method of claim 6, wherein the step of cutting is accomplished by hand cutting or die cutting.

12. The method of claim 6, wherein at least one of the portion of the first layer of foam and the portion of the second layer of foam included in the molded portion has an area of reduced thickness.

13. The method of claim 12, wherein the area of reduced thickness is formed by shaving or compressing at least one of a portion of the first layer of foam and a portion of the second layer of foam prior to the step of molding.

14. The method of claim 6, further comprising the step of including the support pad in an undergarment to be worn by a wearer for supporting at least one breast of the wearer.

15. A method of manufacturing a support pad for an undergarment comprising the steps of molding a first layer of foam to create a convex shape in at least a portion of the first layer of foam;

attaching a layer of support material to at least a portion of the first layer of foam, wherein the support material is mesh;

attaching a second layer of foam to both the first layer of foam and the layer of support material to create a pre-cut block;

molding the pre-cut block to create a three-dimensional molded portion in the pre-cut block, the molded portion including a portion of the first layer of foam, a portion of the second layer of foam and at least a portion of the layer of support material;

cutting the molded portion from the pre-cut block to create a support pad for an undergarment, the support pad being formed by the portion of the first layer of foam, the portion of the second layer of foam and the at least a portion of the layer of support material included in the molded portion.

16. The method of claim 15, further comprising the steps of:

attaching a first layer of lining fabric to the first layer of foam; and attaching a second layer of lining fabric to the second layer of foam.

17. The method of claim 16, wherein:

the support pad has a substantially convex shape with a first surface and a second surface; and the first layer of lining fabric forms the second surface of the support pad and the second layer of lining fabric forms the first surface of the support pad.

18. The method of claim 15, wherein:

the support pad has a perimeter which includes an upper edge being called a neckline edge and a peripheral edge being called an underarm edge; and the support material is positioned adjacent to at least one of the neckline edge and the underarm edge after the step of cutting.

19. The method of claim 15, wherein:

the support pad has a perimeter which includes an upper edge being called a neckline edge; and the support material is positioned adjacent to the neckline edge after the step of cutting.

20. The method of claim 15, wherein the second layer of foam is molded prior to the step of attaching the second layer of foam to both the first layer of foam and the layer of support material to create a pre-cut block.

21. The method of claim 15, wherein at least one of the portion of the first layer of foam and the portion of the second layer of foam included in the molded portion has an area of reduced thickness.

22. The method of claim 21, wherein the area of reduced thickness is formed by shaving or compressing at least one of a portion of the first layer of foam and a portion of the second layer of foam.

23. The method of claim 15, further comprising the step of including the support pad in an undergarment to be worn by a wearer for supporting at least one breast of the wearer.

* * * * *